US009254684B2

(12) United States Patent
Kitagishi et al.

(10) Patent No.: US 9,254,684 B2
(45) Date of Patent: Feb. 9, 2016

(54) RECORDING APPARATUS

(75) Inventors: Mikio Kitagishi, Matsumoto (JP); Miho Ota, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 122 days.

(21) Appl. No.: 13/549,271

(22) Filed: Jul. 13, 2012

(65) Prior Publication Data

US 2013/0016167 A1 Jan. 17, 2013

(30) Foreign Application Priority Data

Jul. 15, 2011 (JP) ..... 2011-156594

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

FOREIGN PATENT DOCUMENTS

| | | |
|---|---|---|
| JP | 02-245336 | 10/1990 |
| JP | 2001-250670 | 9/2001 |
| JP | 2009-072999 | 4/2009 |
| JP | 2009-279877 | 12/2009 |

OTHER PUBLICATIONS

Machine translation of JP 2009-279877 A. (JP 2009-279877 A was published on Dec. 3, 2009).*

* cited by examiner

*Primary Examiner* — Justin Seo
(74) *Attorney, Agent, or Firm* — Workman Nydegger

(57) ABSTRACT

A recording apparatus includes a recording head that ejects fluid onto a recording medium, a transport device that transports the recording medium along a support surface, and a heating device that heats the recording medium. The heating device is provided with plural first heating units in a direction crossing the transport direction in a state where a side of the first heating unit is parallel with the transport direction, and a second heating unit which extends in the transport direction at a boundary region which is present between the neighboring first heating units.

3 Claims, 7 Drawing Sheets

CHANGE DRAWING
(HEATER WIRING ON OUTER CIRCUMFERENCE)

HEATER WIRING IN RELATED ART

RECORDING APPARATUS

BACKGROUND

1. Technical Field

The present invention relates to a recording apparatus.

2. Related Art

As a type of recording apparatuses which eject liquid onto a recording medium and record images and characters, an ink jet printer is known. When ink (fluid) which requires drying in an osmotic or evaporative manner is used in an ink jet printer, it is necessary to provide a drying device to dry the ink ejected onto the recording medium.

When a large printer is used, plural heaters are arranged in a direction crossing a transport direction of a medium to be recorded based on the relationship of resistance values (for example, JP-A-2009-72999).

However, in the configuration disclosed in JP-A-2009-72999, there is a region where a heater is not present at the boundary between neighboring heaters (boundary region) in the transport direction of a medium to be recorded. Since heating is not properly performed on a certain portion of the medium to be recorded which passes through the boundary region in comparison with other parts, temperature nonuniformity occurs and fixity of ink is not even, thereby lowering print quality. Since a heater wire that configures the heater is drawn in a complicated manner, manufacturing costs are increased.

SUMMARY

An advantage of some aspects of the invention is to provide a recording apparatus that is able to suppress costs and remove heating nonuniformity of a medium to be recorded.

According to an aspect of the invention, there is provided a recording apparatus including a recording head that ejects fluid onto a recording medium; a transport device that transports the recording medium along a support surface; and a heating device that heats the recording medium. The heating device is provided with a plurality of first heating units in a direction crossing a transport direction in a state where a side of the first heating unit is parallel with the transport direction, and a second heating unit which extends in the transport direction at a boundary region which is present between the neighboring first heating units.

In this configuration, it is possible to cover a region in which the first heating unit is not present in the direction crossing the transport direction of the recording medium by providing the second heating unit so as to extend in the transport direction at the boundary region which is present between the neighboring first heating units which are arranged in the direction crossing the transport direction of the recording medium. Due to this, heating nonuniformity of the recording medium can be prevented.

In the printing apparatus, the first heating unit may have a plurality of first heaters which extend in the direction crossing the transport direction and are arranged in the transport direction at a predetermined interval, and the second heating unit may have a second heater which faces at least one side of the plurality of first heaters.

In this configuration, the second heater is present corresponding to a range of the first heating unit in the transport direction by providing the second heater which faces at least one side of the plurality of first heaters. Due to this, it is possible to evenly heat the recording medium in the direction crossing the transport direction of the recording medium.

In the recording apparatus, the plurality of first heaters and a connection unit which is alternately connected with each of the first heaters may be formed by wiring a heater wire in a serpentine manner, and the second heater may be formed by drawing the heater wire in the transport direction.

In this configuration, the first heater and the second heater can be formed together by drawing one heater wire. Thus, it is possible to reduce the number of parts and suppress costs and the wiring operation is easy.

In the recording apparatus, the second heating unit may be provided with a plurality of second heaters.

In this configuration, heating efficiency closer to that of the first heating unit can be applied to the second heating unit by providing the plurality of second heaters.

The second heaters may be provided on both sides of the plurality of first heaters.

In this configuration, it is possible to heat both sides of the recording medium in a width direction without nonuniformity, and more evenly heat the whole recording medium.

In the recording apparatus, the first heater and the second heater may be formed by drawing one heater wire and both ends of the heater wire may be pulled out in the same direction.

According to this configuration, the number of parts is reduced so it is possible to suppress costs and make the heater wire laying operation easy. Thus, it is possible to simplify the manufacture. Since both ends of the heater wire are pulled out in the same direction, a wiring that is connected to the heater wire can be easily arranged.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the accompanying drawings. Each member is properly altered in scale to have a recognizable size in the respective drawings used in description below.

First Embodiment

Figure 1:
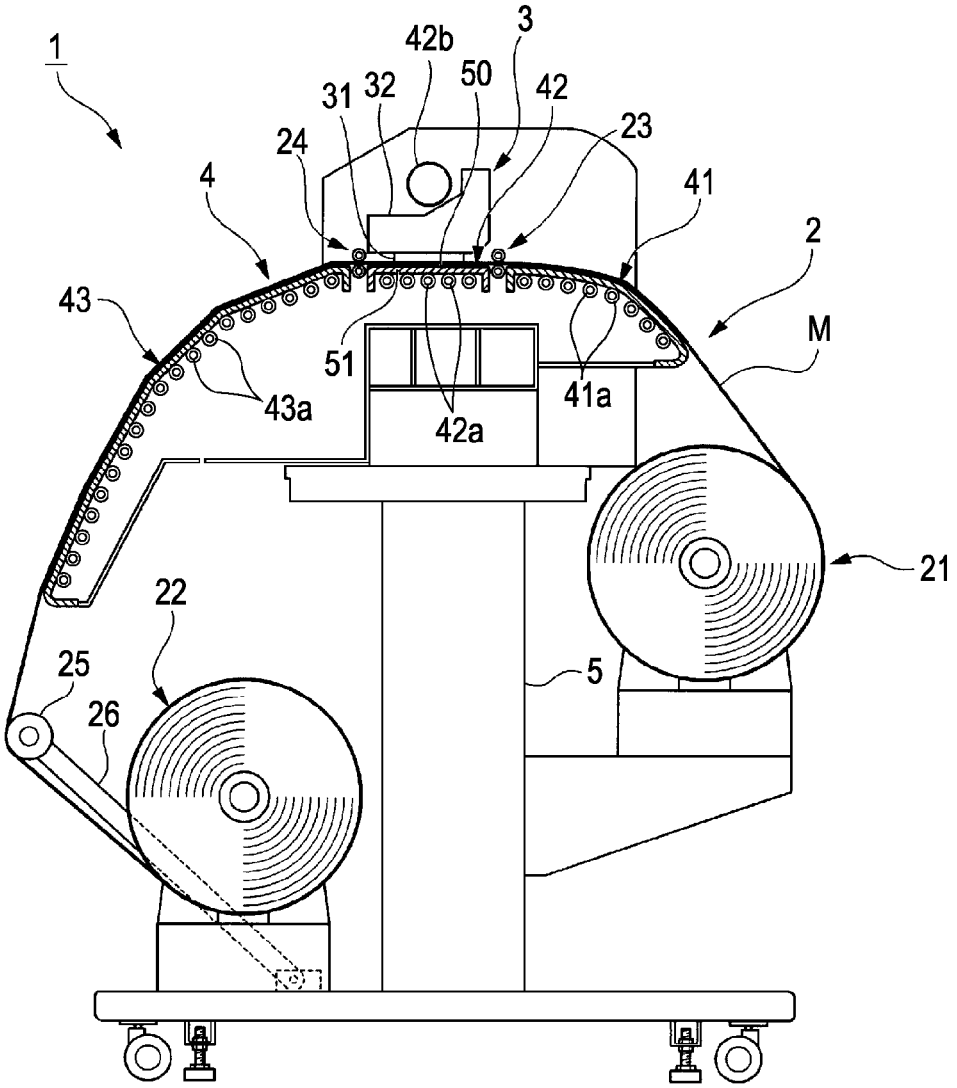
FIG. 1 is a view showing a configuration of a printer as a recording apparatus according to an embodiment of the invention.

FIG. 1 is a view showing a configuration of a printer 1 as a recording apparatus according to an embodiment of the invention.

The printer 1 is a large format printer (LFP) which handles a relatively large medium (recording medium) M. A medium M in the embodiment is formed with a vinyl chloride film of about 64 inches in width, for example.

As shown in FIG. 1, the printer (recording apparatus) 1 includes a transporting unit (transport device) 2 which transports the medium M in a roll-to-roll method, a recording unit 3 which ejects ink (fluid) to the medium M to record images and characters, and a heating unit (heating device) 4 which heats the medium M. Each unit is supported by a body frame 5.

The transporting unit 2 has a roll 21 which sends the medium M in a roll state, and a roll 22 which winds the sent medium M. The transporting unit 2 has a pair of transport rollers 23 and 24 which transport the medium M in a transporting path between the roll 21 and the roll 22. The transporting unit 2 has a tension roller (tension device) 25 which applies tension to the medium M in the transporting path between the pair of transport rollers 23 and 24 and the roll 22.

The tension roller 25 is configured to be supported by a rocking frame 26, and contact a rear surface of the medium M in a width direction (a vertical direction of a paper plane in FIG. 1). The tension roller 25 is longer than the width of the medium M in the width direction. The tension roller 25 is provided downstream of the transport direction of an afterheater 43 in the heating unit 4 described below.

The recording unit 3 has an ink jet head (recording head) 31 which ejects ink onto the medium M in the transporting path between the pair of transport rollers 23 and 24, and a carriage 32 in which the ink jet head 31 is loaded to freely reciprocate in the width direction. The ink jet head 31 is configured to be provided with plural nozzles and be able to eject ink that is selected based on the relationship to the medium M and requires drying in an osmotic or evaporative manner.

The heating unit 4 is configured to make the ink promptly dry and fix to the medium M by heating the medium M, and prevent smudges and blurs to increase image quality. The heating unit 4 has a support surface configuring a part of the transporting path for the medium M, bends the medium M between the rolls 21 and 22 so as to make the medium upwardly convex, supports the medium M, and heats the medium M on the support surface.

The heating unit 4 has a preheater 41 which preheats the medium M upstream of the transport direction from the position where the recording unit 3 is provided, a platen heater 42 which heats the medium M in the position which faces the recording unit 3, and an afterheater 43 which heats the medium M downstream of the transport direction from the position where the recording unit 3 is provided.

In the embodiment, the preheater 41 is configured to heat the medium M to gradually increase the temperature of the medium from room temperature to a target temperature (the temperature in the platen heater 42), and facilitates prompt drying of the ink from the time of landing.

The platen heater 42 is configured to make the medium M receive the ink landing in a state in which the target temperature is maintained, and facilitates prompt drying of the ink from the time of landing. The platen heater 42 has a platen (supporting member) 51 which has a support surface to support the medium M, and a heater 42*b* which is provided in a position facing the support surface 50 of the platen 51. The platen heater 42 indirectly heats the medium M supported on the support surface 50 of the platen 51 from the rear side of the medium, and directly heats the medium M from a front surface to a recording surface of the medium with infrared energy irradiation.

The afterheater 43 is configured to heat the medium M to have a temperature higher than the target temperature, promptly dry portions of ink, of the ink which has landed on the medium M, which has not yet dried, and completely dry and fix the landed ink to the medium M at least before the roll 22 winds the medium M.

Next, a characteristic configuration in the afterheater 43 of the embodiment will be described.

Figure 2:
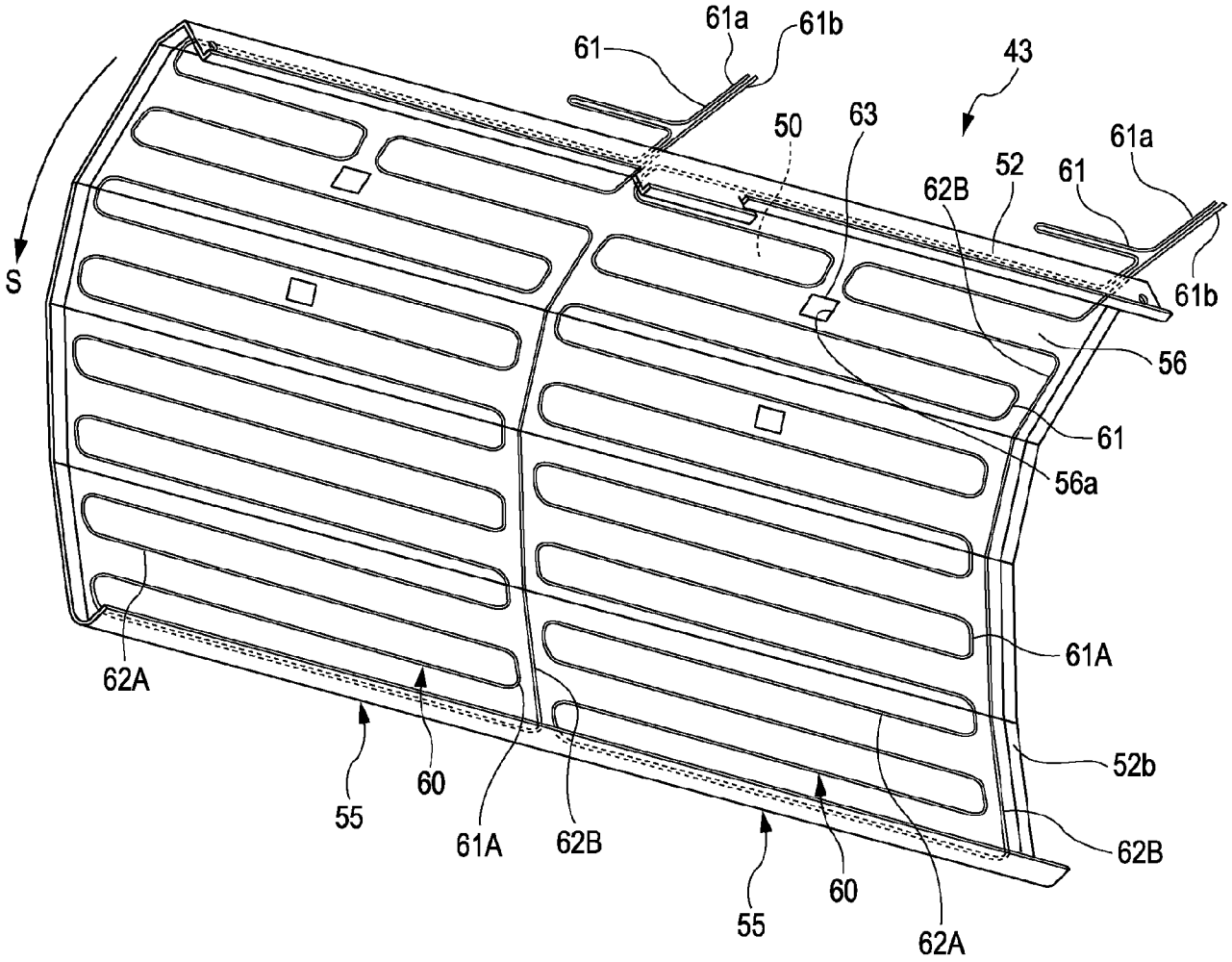
FIG. 2 is a perspective view showing a configuration of an afterheater according to a first embodiment of the invention.
Figure 3:
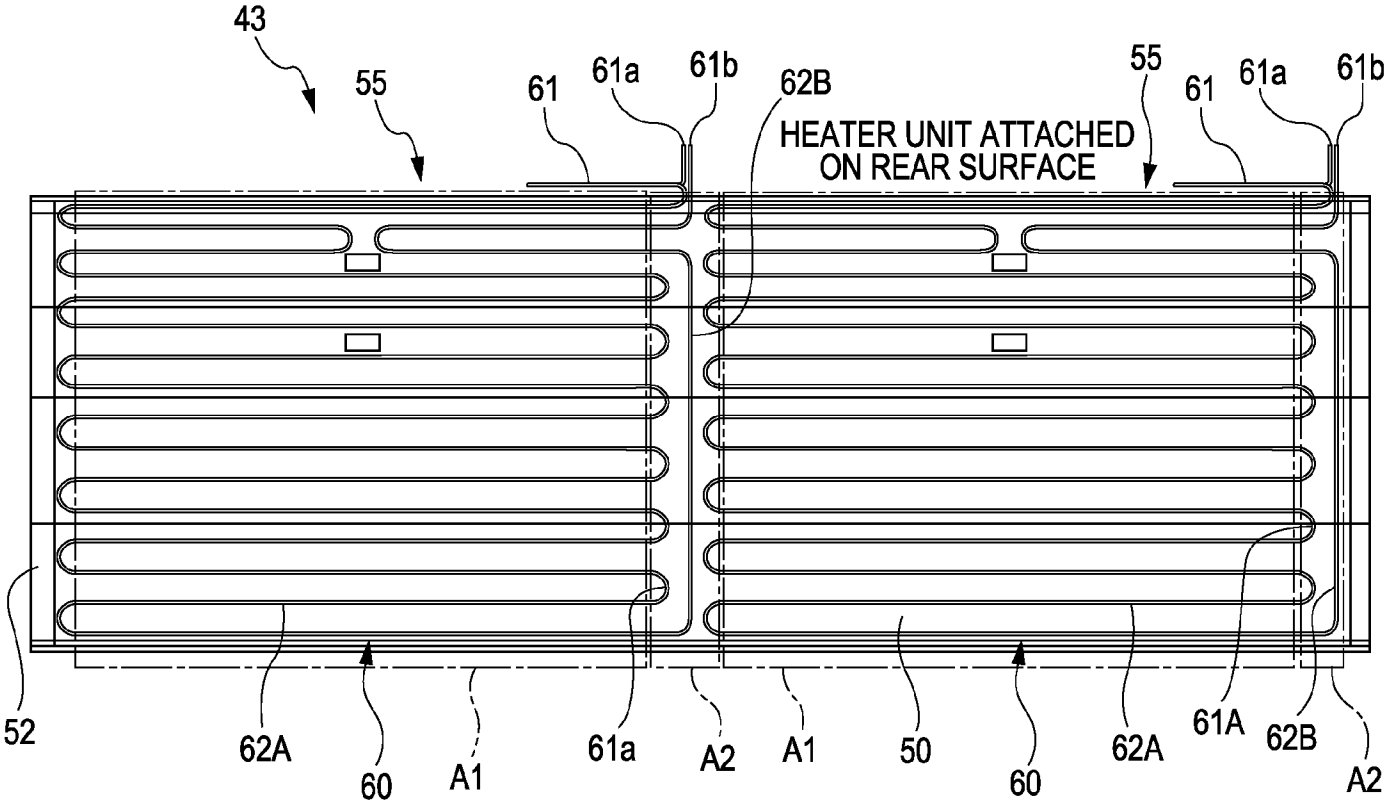
FIG. 3 is a plan view showing the configuration of the afterheater.
Figure 4:
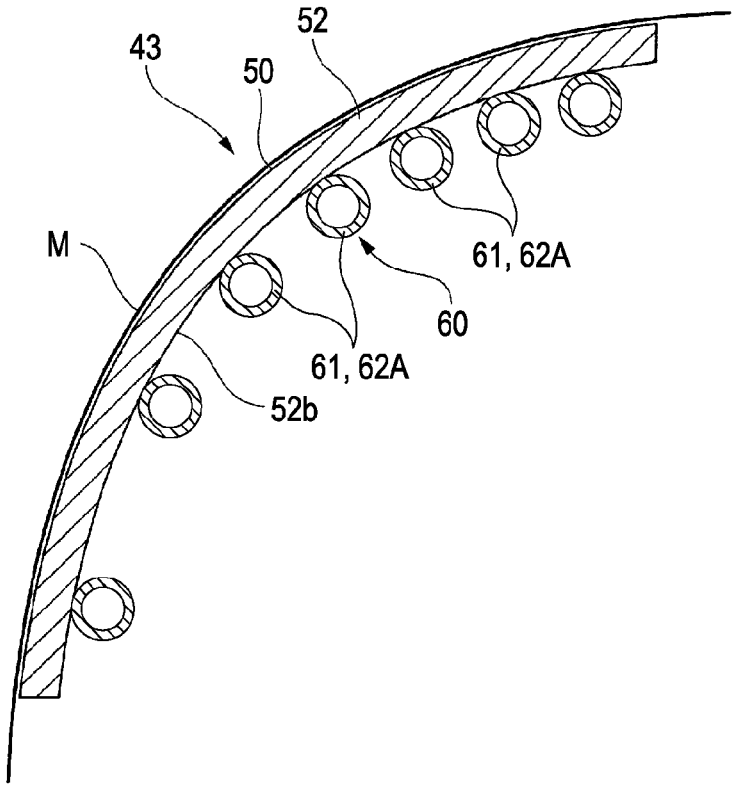
FIG. 4 is a cross-sectional view showing the configuration of the afterheater.

FIG. 2 is a perspective view showing a configuration of an afterheater according to a first embodiment of the invention. FIG. 3 is a plan view showing the configuration of the afterheater. FIG. 4 is a cross-sectional view showing the configuration of the afterheater.

As shown in FIGS. 2 and 3, the afterheater 43 is provided with plural first heating regions (first heating units) A1 which exhibit rectangular shapes in plan view, and are arranged in the direction crossing the transport direction of the medium M. One side of the first heating regions A1 is parallel with the transport direction of the medium M. At least, at a boundary part between the first heating regions A1, a second heating region (second heating unit) A2 which extends in the transport direction of the medium M (along the other side of the first heating regions A1) is provided.

Hereinafter, the configuration will be described in detail.

The afterheater 43 includes a supporting member 52 which has a support surface 50 to support the medium M. The supporting member 52 of the embodiment is formed with a steel plate, specifically, a cold rolled steel plate (SPCC). The supporting member 52 is longer than the paper width of the medium M in the width direction, specifically, longer than a width of about 64 inches.

As shown in FIGS. 2 to 4, the afterheater 43 is configured to provide plural heater sections 55 arranged in the direction crossing the transport direction of the medium M, and to be able to evenly heat the medium M in the width direction. In the embodiment, two heater sections 55 are arranged, but it is not limited to this. Each of the heater sections 55 is configured to have heater unit 60 which is provided on a rear side of the supporting member 52 having the support surface 50, and heat the medium M supported by the support surface 50 from the rear side of the medium in heat conduction, through the supporting member 52.

The heater unit 60 is made up of a tubular heater (heater wire) 61, and is attached on a rear surface 52*b* of the supporting member 52 with aluminum tape 56. The tubular heater 61 is laid so as to wind in a shape of a winding road on a front surface of the aluminum tape 56 (a surface opposite to the attached surface).

Plural heaters (first heaters) or heater segments or units 62A of the tubular heater 61 are provided in the transport direction of the medium M (the direction indicated with arrow S in FIG. 2) at a predetermined interval. The interval between the neighboring heaters segments 62A in the transport direction of the medium M is constant, and the heaters segments are arranged at an interval of 30 to 35 mm in the embodiment. The heater segment 62A indicates or represents a region of the tubular heater 61 which extends in the width direction of the supporting member 52 (paper width direction) in the tubular heater 61 laid to be serpentine in the direction crossing the transport direction of the medium M. Stated another way, the heater segment 62A is a horizontal segment or segment extending perpendicularly to the transport direction and is a portion of the tubular heater 61. The heater segment or unit 62A is a heater unit for heating the first heating region (first heating unit) A1 in a transporting region of the medium M in the supporting member 52.

The tubular heater 61 of the embodiment has the heater (second heater) or heater segments or units 62B which extends in the transport direction of the medium M. The heater segment 62B is one side of the plural heater segment 62A, and provided at the boundary part with the neighboring heater section 55. The heater segment or unit 62B indicates or represents a region of the tubular heater 61 which extends in the transport direction of the medium M.

The heater 62B is a heater unit for heating a second heating region (second heating unit) A2 which is at least a region of the boundary part between the neighboring first heating regions A1 in the direction crossing the transport direction of the medium M of the transporting region of the medium M in the supporting member 52.

The heater unit 60 has a thermostat 63 to adjust the temperature of the tubular heater 61. The thermostat 63 is arranged in a hole 56*a* formed in the aluminum tape 56, and maintains temperature of the tubular heater 61 at predetermined temperature during a recording process. In the embodiment, the amount of energy supplied to the tubular heater 61 is controlled so that the tubular heater 61 maintains the temperature at 50 degrees.

Next, temperature distribution in the afterheater will be compared with a configuration of an afterheater in the related art.

Figure 5:
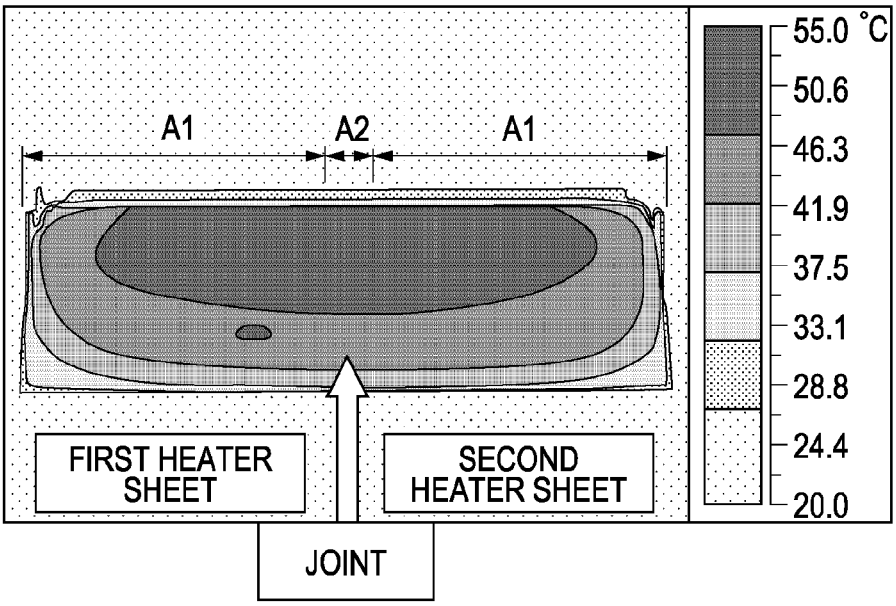
FIG. 5 is a view showing temperature distribution of the afterheater according to the first embodiment.
Figure 6A:
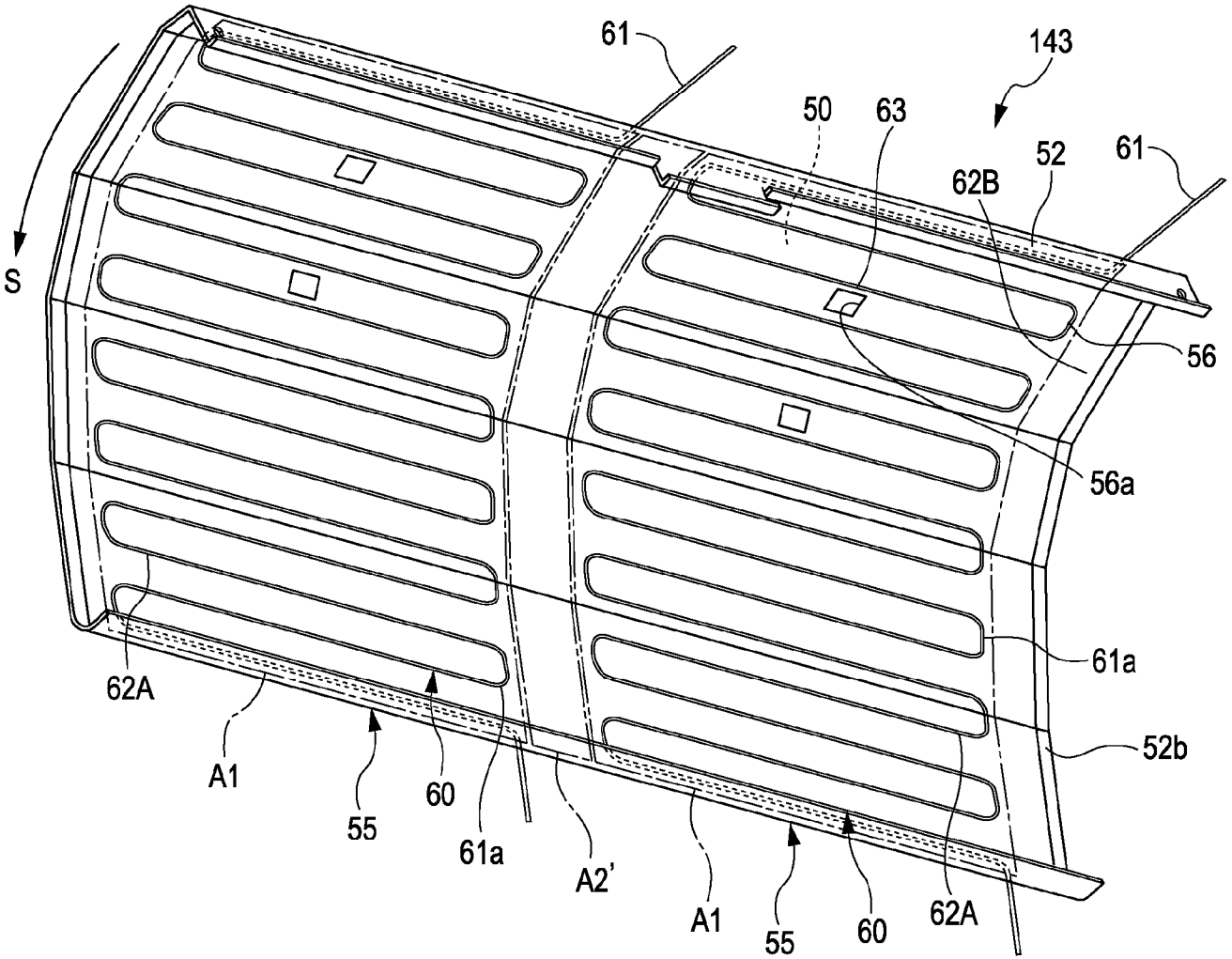
FIG. 6A is a perspective view showing a configuration of an afterheater in the related art, and 6B is a view showing temperature distribution of the afterheater in the related art.

FIG. 5 is a view showing temperature distribution of the afterheater in the embodiment. FIG. 6A is a perspective view showing a configuration of an afterheater in the related art, and 6B is a view showing temperature distribution of the afterheater in the related art.

Figure 6B:
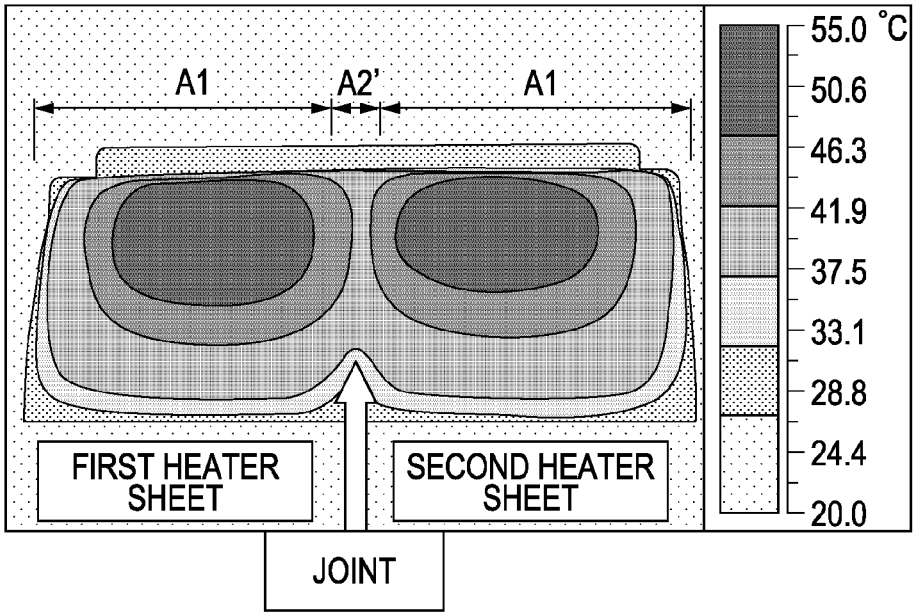

In the configuration of the afterheater 143 of the related art shown in FIG. 6A, the tubular heater 61 is not laid at the boundary region A2' between the neighboring heater sections 55, and there is a region in which the heater wire is not present in the width direction of the medium M in a broad range compared with the embodiment. Due to this, heating efficiency at the boundary region A2' is significantly lowered in comparison with the first heating region A1. Resultantly, as shown in FIG. 6B, there are differences in temperature between the plural first heating regions A1 and the boundary region A2' of the first heating regions, and the medium M can be evenly heated in the paper width direction.

In contrast to this, as shown in FIGS. 2 and 3, the heater is provided at the boundary part between the first heating regions A1 in the transport direction so that the second heating region (boundary region) A2 to which a heating action the same as that in the first heating region A1 is present in the embodiment. That is, the heater 62B is formed by facing the respective connection units 61A of the neighboring heater sections 55 in the direction crossing the transport direction of the medium M, drawing the tubular heater 61 in the second heating region A2 including the boundary part, and extending the tubular heater linearly in the transport direction. Due to the heater 62B, as shown in FIG. 5, it is possible to cover the region where a heater is not present at the boundary part of the heater sections 55 in the direction crossing the transport direction of the medium M, and make the heating temperature in the second heating region A2 and the first heating regions A1.

In the embodiment, the heater unit is provided at the boundary part between the first heating regions A1 in the transport direction of the medium M so that heating efficiency the same as the first heating region A1 can be applied to the boundary region A2. Due to this, heating is properly performed on a certain portion of the medium M that passes through the second heating region A2 in the same manner as a part that passes through the first heating region A1, and the temperature nonuniformity (heating nonuniformity) in the width direction of the medium M is resolved so that the whole paper width of the medium is evenly heated.

The first heating regions (first heating units) A1 having the rectangular shape are arranged in a state in which one side of the first heating regions is parallel with the transport direction of the medium M. Since the second heating region (second heating unit) A2 is provided in the transport direction of the medium M, the second heating region extends along the other side of the first heating regions (first heating units) A1. Since the first heating regions (first heating unit) A1 and the second heating region (second heating unit) A2 are rectangular in outer shape, handling becomes easy, and transportation costs can be suppressed unlike a case where complicated shapes are used.

In the embodiment, plural heaters 62A are formed by the tubular heater 61, and the heater 62B is formed by drawing the tubular heater on one side in the direction where each heater 62A extends so as to cross the serpentine direction of the tubular heater. Since one tubular heater 61 is drawn around the first heating region A1 and the second heating region A2 to form the respective heaters 62A and 62B, the number of parts is small. Thus, costs can be reduced.

Since the tubular heater 61 requires being laid linearly in the transport direction of the medium M in the second heating region A2, it is easy to manufacture.

By pulling out the end 61*b* of the tubular heater 61 laid in the second heating region A2 in a direction the same as the pulling direction of the end 61*a* of the tubular heater 61 laid in the first heating region A1, the wire connected to each end 61*a* and 61*b* is easily arranged. Thus, it is possible to prevent the wire from being accommodated complexly in the apparatus.

In the embodiment, the heater 62B is provided on only one side of the plural heaters 62A in each heater section 55. Since such heater sections 55 are arranged in the same direction, the heater 62B is not provided on one side in the width direction of the supporting member 52 (one side in the paper width direction of the medium M). The heater 62B may be provided on both sides of the plural heater 62A. For this reason, heating is performed more evenly on the medium M.

Second Embodiment

Next, a configuration of a second embodiment in the invention will be described.

The basic configuration of the embodiment is the same as the first embodiment, but a configuration of an afterheater is different. Accordingly, a different part in the configuration of the afterheater will be mainly described in the following description.

Figure 7:
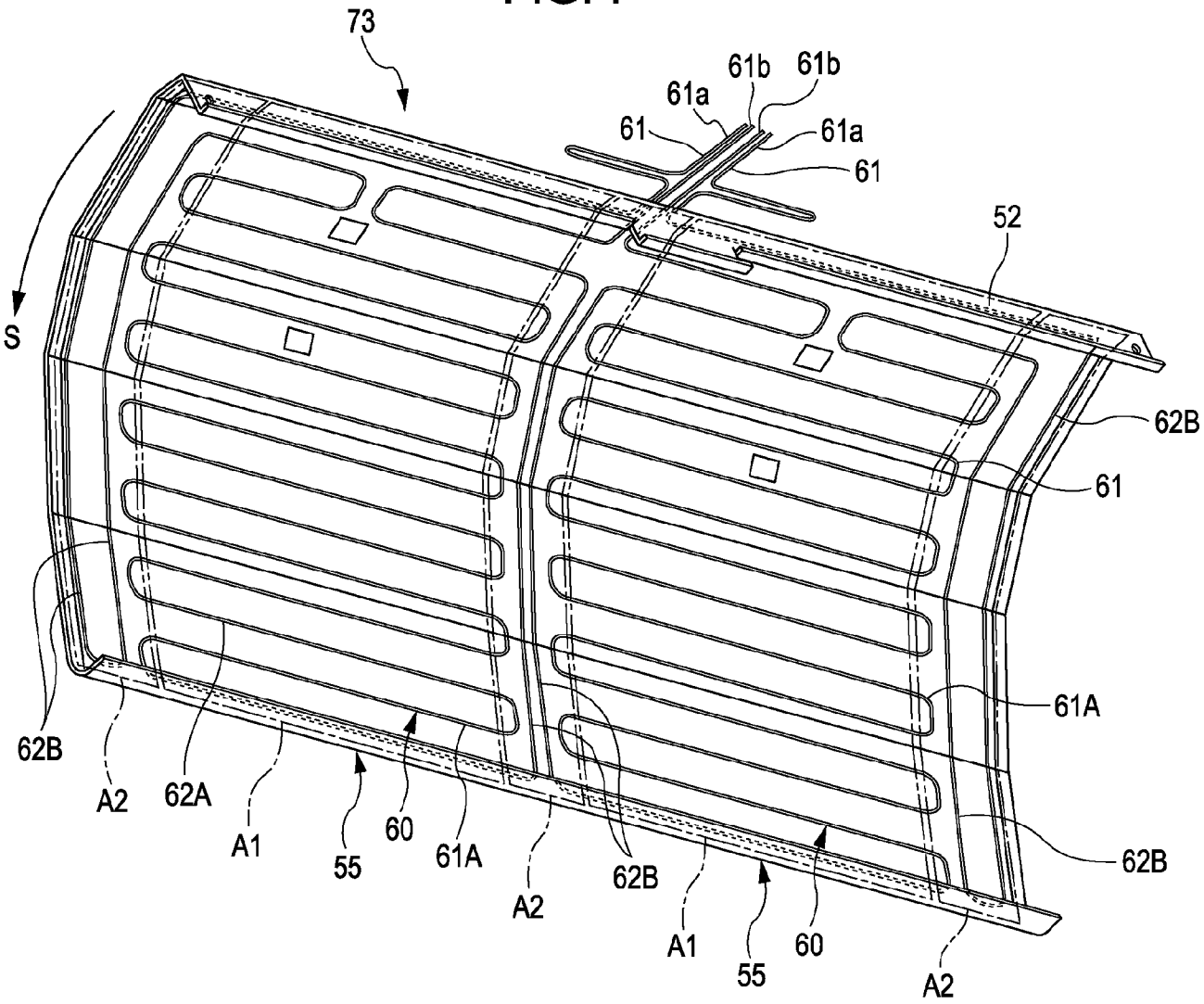
FIG. 7 is a perspective view schematically showing a configuration of an afterheater according to a second embodiment.

FIG. 7 is a perspective view schematically showing the configuration of the afterheater according to the second embodiment.

As shown in FIG. 7, every heater section 55 has only one heater 62B in the first embodiment. However, the afterheater 73 in the embodiment has plural heaters 62B in each heater section 55.

In the embodiment, the tubular heater 61 is laid so that the configurations of the neighboring heater sections 55 are symmetrical. Thus, the second heating regions A2 in which the plural heater 62B are laid respectively are present on both sides of the first heating regions A1. It is possible to evenly heat not only the boundary region between the heater sections 55 but also an end region respectively corresponding to both ends of the medium M. Heating the medium M can be more evenly performed in the paper width direction to remove drying nonuniformity.

Here, the tubular heater 61 is laid and arranged such that two heaters 62B are present in each second heating region A2. However, the number of the heater 62B in the second heating region A2 is not limited to this, and 3 or more heaters may be present.

According to the configuration of the embodiment, the same heating amount as the first heating region A1 can be more effectively given to the second heating region A2. The certain portion of the medium passing on the second heating region A2 can be properly heated like the part passing on the first heating region A1, and temperature nonuniformity (heating nonuniformity) on both sides in the width direction of the medium M is resolved. Thus, the whole paper width can be evenly heated.

Since the heaters 62A and 62B are formed by drawing one tubular heater 61 in the embodiment, the number of parts is small. Thus, the laying operation is easy.

As described above, in a case of a large printer drying the ink on the medium M after recording using plural heater sections 55 arranged in the direction crossing the transport direction of the medium M, the region where the heater 62A is not present at the boundary part between the heater sections 55 is linearly formed in the transport direction of the medium M. On the other hand, since the phenomenon that only a certain region of the medium M continuously passes through the region where the heater is not present is no longer present, by providing the heater 62B which extends in the transport direction at the boundary region, it is possible to prevent drying nonuniformity.

In each embodiment, the heaters 62A and 62B are formed by drawing one tubular heater 61 so that the outer shape is rectangular in plan view so drawing the heater wire is simple and manufacturing costs can be suppressed. Further, since the outer shape of the heater section 55 is rectangular, packing is easy and transportation costs can be suppressed unlike the case of a complicated outer shape.

While the preferred embodiments of the invention have been described above with reference to the accompanying drawings, it is needless to say that the invention is not limited to these examples. Those skilled in the art can easily conceive of various alterations and modifications within the scope of the technical idea disclosed in the claims and will understand that these alterations and modifications belong to the claims of the invention.

As a recording apparatus, a recording apparatus which ejects or discharges fluid other than ink may be employed. The invention may be used in various recording apparatuses having recording heads or the like for discharging minute amounts of liquid droplets. In this case, liquid droplets denotes a state of a liquid discharged from the aforementioned recording apparatuses and also includes liquid droplets leaving a tail in a granular state, a tear-like state, and a thread-like state. In addition, the liquid referred herein may be a material which may be ejected by the recording apparatuses. For example, a material in a liquid state may be used. In addition, a liquid state having a high or low viscosity, a sol solution, a gel water, other fluid state such as inorganic solvents, organic solvents, solutions, liquid resins, and liquid metals (metal solution) may be contained. In addition, a material where particles of a functional material made of a solid material such as pigments or metal particles are dissolved into a solvent, dispersed, or mixed as well as a liquid as a one-state material may be contained. In addition, as a representative example of the liquid, there may be an ink described in the aforementioned embodiments. Herein, the ink may include general water-based ink and oil-based ink and various types of liquid compounds such as a gel ink and a hot-melt ink. In addition, as a recording medium, paper, high performance paper, a substrate, and a metal plate other than a plastic film such as a vinyl chloride film may be included.

The entire disclosure of Japanese Patent Application No.2011-156594, filed Jul. 15, 2011 is expressly incorporated by reference herein.

What is claimed is:

1. A recording apparatus comprising:

a recording head that ejects fluid onto a recording medium;

a transport device that transports the recording medium along a support surface; and a heating device that heats the recording medium, the heating device including a plurality of heater units arranged to provide:

a plurality of first heating regions extending in a direction crossing a transport direction, with a side of each first heating region being parallel with the transport direction, wherein each heater unit is associated with one of the first heating regions, and a second heating region between neighboring first heating regions, wherein the second heating region is associated with neighboring heater units and extends in the transport direction at a boundary region which is present between the neighboring heater units, wherein sides of the second heating region at the boundary region between the neighboring heater units are parallel with the transport direction, wherein a heater wire extends in a serpentine manner between one of the plurality of first heating regions and the second heating region, the heater wire including a plurality of first heater segments extending in the direction crossing the transport direction, a plurality of connection portions alternately connecting the plurality of first heater segments, and a second heater segment extending past the plurality of connection portions in the transport direction, the plurality of the connection portions and the second heater segment being within the second heating region, the plurality of connection portions being aligned in the transport direction with the second heater segment extending parallel to the transport direction.

2. The recording apparatus according to claim 1, wherein the plurality of first heater segments are arranged in the transport direction at a predetermined interval.

3. The recording apparatus according to claim 1, wherein the plurality of heater units are each formed from one heater wire and both ends of the heater wire are pulled out in the same direction.

* * * * *